US009188124B2

(12) United States Patent
Utpat et al.

(10) Patent No.: US 9,188,124 B2
(45) Date of Patent: Nov. 17, 2015

(54) SCROLL COMPRESSOR WITH UNLOADER ASSEMBLY

(71) Applicant: Emerson Climate Technologies, Inc., Sidney, OH (US)

(72) Inventors: Ajay Utpat, Pune (IN); James A. Schaefer, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 274 days.

(21) Appl. No.: 13/869,567

(22) Filed: Apr. 24, 2013

(65) Prior Publication Data

US 2014/0147324 A1 May 29, 2014

(30) Foreign Application Priority Data

Apr. 30, 2012 (IN) ..... 1344/MUM/2012

(51) Int. Cl.
*F04C 18/02* (2006.01)
*F04C 29/00* (2006.01)

(52) U.S. Cl.
CPC ..... *F04C 18/0215* (2013.01); *F04C 29/0071* (2013.01); *F04C 29/0078* (2013.01); *F04C 2240/56* (2013.01); *F04C 2240/60* (2013.01)

(58) Field of Classification Search
CPC ..... F04C 18/0215; F04C 2240/56; F04C 2240/60; F04C 29/0071; F04C 29/0078
USPC ..... 418/55.1, 55.5
See application file for complete search history.

(56) References Cited

U.S. PATENT DOCUMENTS

| | | | |
|---|---|---|---|
| 4,300,875 | A | 11/1981 | Fischer et al. |
| 4,877,382 | A | 10/1989 | Caillat et al. |
| 5,295,813 | A | 3/1994 | Caillat et al. |
| 5,378,129 | A | 1/1995 | Dunaevsky et al. |
| 5,520,524 | A | 5/1996 | Takemoto et al. |

(Continued)

FOREIGN PATENT DOCUMENTS

| | | | |
|---|---|---|---|
| CN | 1186174 | A | 7/1998 |
| CN | 101545483 | A | 9/2009 |

(Continued)

OTHER PUBLICATIONS

First Chinese Office Action regarding Application No. 201310158952.1, dated May 5, 2015. Translation provided by Unitalen Attorneys at Law.

*Primary Examiner* — Jorge Pereiro
*Assistant Examiner* — Paul Thiede
(74) *Attorney, Agent, or Firm* — Harness, Dickey & Pierce, P.L.C.

(57) ABSTRACT

A compressor may include a shell, orbiting and non-orbiting scrolls, an unloader bushing assembly and a drive shaft. The unloader bushing assembly may include a drive bushing and a spring. The drive bushing includes an outer surface engaged with the orbiting scroll and may define an opening extending from a first bushing end to a second bushing end. The spring may include a body disposed within the opening of the drive bushing and may include first and second spring ends with at least a portion of the first spring end extending laterally from the body and overlapping the first bushing end. At least a portion of the second spring end may extend laterally from a body and overlap the second bushing end to secure the spring within the drive bushing. The drive shaft may include a crank pin disposed within the opening of the drive bushing and engaging the spring.

12 Claims, 4 Drawing Sheets

(56) References Cited

U.S. PATENT DOCUMENTS

| | | | | |
|---|---|---|---|---|
| 5,545,019 | A | 8/1996 | Beck et al. | |
| 6,089,840 | A | 7/2000 | Iizuka et al. | |
| 6,106,251 | A | 8/2000 | Monnier et al. | |
| 6,189,248 | B1 * | 2/2001 | Nagel et al. | 40/661.03 |
| 6,428,294 | B1 | 8/2002 | Fenocchi | |
| 6,695,600 | B2 | 2/2004 | Koo et al. | |
| 7,273,363 | B1 | 9/2007 | Sun et al. | |
| 8,186,981 | B2 | 5/2012 | Sugimoto et al. | |
| 2009/0246057 | A1 * | 10/2009 | Sugimoto | F04C 18/0215 418/55.1 |
| 2012/0258003 | A1 | 10/2012 | Hahn | |

FOREIGN PATENT DOCUMENTS

| | | | | |
|---|---|---|---|---|
| CN | 203453056 | U | 2/2014 | |
| JP | 2000161256 | A * | 6/2000 | F04C 18/02 |
| WO | WO-9410425 | A1 | 5/1994 | |
| WO | WO-2010113794 | A1 | 10/2010 | |

* cited by examiner

SCROLL COMPRESSOR WITH UNLOADER ASSEMBLY

CROSS-REFERENCE TO RELATED APPLICATIONS

This application claims the benefit and priority of Indian Patent Application No. 1344/MUM/2012, filed Apr. 30, 2012. The entire disclosure of the above application is incorporated herein by reference.

FIELD

The present disclosure relates to unloader assemblies in scroll compressors.

SUMMARY

This section provides a general summary of the disclosure, and is not comprehensive of its full scope or all of its features.

A compressor may include a shell, a bearing housing supported within the shell, an orbiting scroll supported on the bearing housing, a non-orbiting scroll meshingly engaged with the orbiting scroll, an unloader bushing assembly and a drive shaft. The unloader bushing assembly may include a drive bushing and a spring. The drive bushing may have an outer surface engaged with the orbiting scroll and defining a longitudinally extending opening extending from a first longitudinal bushing end to a second longitudinal bushing end. The spring may include a longitudinally extending body disposed within the longitudinally extending opening of the drive bushing and having first and second longitudinal spring ends with at least a portion of the first longitudinal spring end extending laterally from the body and overlapping the first longitudinal bushing end. At least a portion of the second longitudinal spring end may extend laterally from a body and overlap the second longitudinal bushing end to secure the spring within the drive bushing. The drive shaft may extend through the bearing housing and may include an eccentric crank pin disposed within the longitudinally extending opening of the drive bushing and engaged with the spring.

The first longitudinal spring end may include a first tab extending laterally from a first lateral spring end and a second tab extending laterally from a second lateral spring end opposite the first lateral spring end. The first and second tabs may extend over a first end surface defined by the first longitudinal bushing end. The second longitudinal spring end may include a third tab extending laterally from the first lateral spring end and a fourth tab extending laterally from the second lateral spring end. The third and fourth tabs may extend over a second end surface defined by the first longitudinal bushing end. The spring may include an inner surface facing the eccentric crank pin and an outer surface opposite the inner surface. The second longitudinal spring end may include a third tab extending outward from the outer surface over a second end surface defined by the second longitudinal bushing end. The first longitudinal bushing end may define a first recess including a first region of the first end surface and a second recess including a second end of the first end surface with the first tab extending into the first recess and a second tab extending into the second recess.

The drive bushing may define a guide region at a location circumferentially between the first and second recesses that extends longitudinally outward from end surfaces defined by the first and second recesses and defines an inner surface engaged with the first longitudinal spring end. The drive bushing may include a first longitudinal wall extending from the first recess and a second longitudinal wall extending from the second recess with the first longitudinal spring end retained for lateral displacement between a first location defined by the first and second longitudinal walls and a second location defined by the inner surface of the guide region.

The spring may include an inner surface facing the eccentric crank pin and an outer surface opposite the inner surface. The first longitudinal spring end may include an additional tab located laterally between the first and second tabs and extending outward from the outer surface over an additional end surface defined at the first longitudinal bushing end.

The second longitudinal spring end may include a third tab extending laterally from the first lateral spring end and into a third recess defined by the second longitudinal bushing end and a fourth tab extending laterally from the second lateral spring end opposite the first lateral spring end and into a fourth recess defined by the second longitudinal bushing end.

The bushing may include a ramped inner surface at least partially defining the longitudinally extending opening. The first longitudinal spring end may be engaged with the ramped surface and may apply a variable spring load against the eccentric crank pin as the first longitudinal spring end is displaced longitudinally along the ramped surface. The first spring may be generally convex along the longitudinal extent of the longitudinally extending body toward a center of the longitudinally extending opening. The spring may include an inner surface facing the eccentric crank pin and an outer surface opposite the inner surface. The first longitudinal spring end may include a tab extending outward from the outer surface over an end surface defined by the first longitudinal bushing end.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
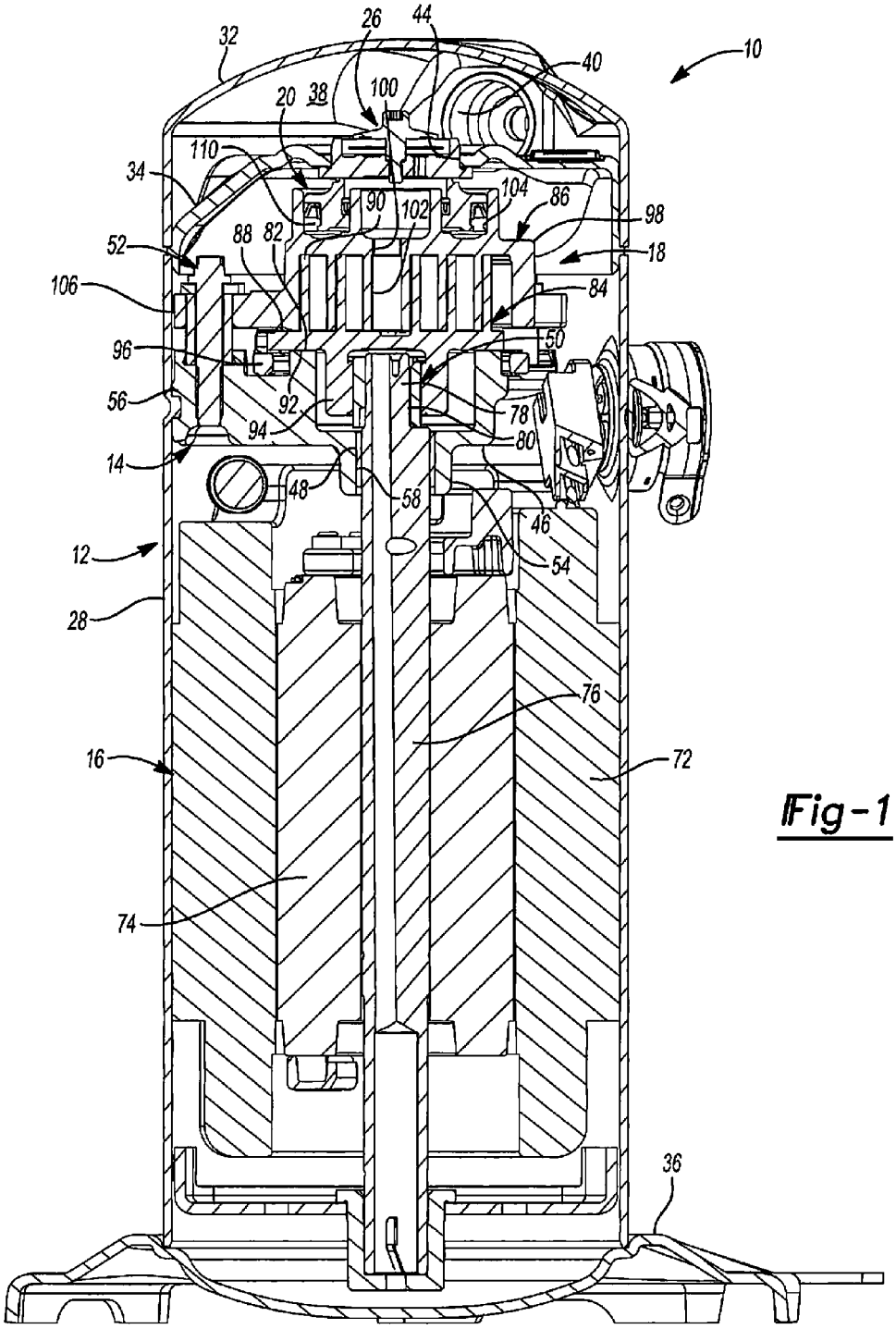
FIG. 1 is a section view of a compressor according to the present disclosure.

With reference to FIG. 1, the compressor 10 may include a hermetic shell assembly 12, a bearing housing assembly 14, a motor assembly 16, a compression mechanism 18, a seal assembly 20 and a discharge valve assembly 26. The shell assembly 12 may house the bearing housing assembly 14, the motor assembly 16, the compression mechanism 18, and the discharge valve assembly 26.

The shell assembly 12 may generally form a compressor housing and may include a cylindrical shell 28, an end cap 32 at the upper end thereof, a transversely extending partition 34, and a base 36 at a lower end thereof. The end cap 32 and the partition 34 may generally define a discharge chamber 38. The discharge chamber 38 may generally form a discharge muffler for compressor 10. While illustrated as including the discharge chamber 38, it is understood that the present disclosure applies equally to direct discharge configurations. The shell assembly 12 may define an opening 40 in the end cap 32 forming a discharge outlet. The shell assembly 12 may additionally define a suction inlet (not shown). The partition 34 may include a discharge passage 44 housing the discharge valve assembly 26.

The bearing housing assembly 14 may include a main bearing housing 46, a bearing 48, an unloader bushing assembly 50, and fasteners 52. The main bearing housing 46 may include a central body 54 with arms 56 extending radially outward from the central body 54. The central body 54 may include a bore defined by a circumferential wall 58 housing the bearing 48. The arms 56 may be engaged with the shell 28 to support the main bearing housing 46 within the shell 28. The main bearing housing 46 may be fixed to the shell 28 at a plurality of points in any desirable manner, such as staking. The unloader bushing assembly 50 may include a drive bushing 60 and a spring 62 (seen in FIGS. 2-4).

The motor assembly 16 may include a motor stator 72, a rotor 74, and a drive shaft 76. The motor stator 72 may be press fit into the shell 28. The rotor 74 may be press fit on drive shaft 76 and the drive shaft 76 may be rotationally driven by rotor 74. The drive shaft 76 may extend through the bore defined by circumferential wall 58 and be rotationally supported within the main bearing housing 46 by the bearing 48.

The drive shaft 76 may include an eccentric crank pin 78 having a flat 80 thereon. The drive bushing 60 may be located on the eccentric crank pin 78 and engaged with the compression mechanism 18. The spring 62 may be located in the drive bushing 60 between the drive bushing 60 and the eccentric crank pin 78 and may engage the eccentric crank pin 78 of the drive shaft 76. The longitudinal extent of the spring 62 may be generally convex toward the eccentric crank pin 78 of the drive shaft 76. The main bearing housing 46 may define a thrust bearing surface 82 supporting the compression mechanism 18. The compression mechanism 18 may include an orbiting scroll 84 and a non-orbiting scroll 86 meshingly engaged with one another.

The orbiting scroll 84 may include an end plate 88 having a spiral vane or wrap 90 on the upper surface thereof and an annular flat thrust surface 92 on the lower surface. The thrust surface 92 may interface with the annular flat thrust bearing surface 82 on the main bearing housing 46. A cylindrical hub 94 may project downwardly from the thrust surface 92 and may have the drive bushing 60 rotatably disposed therein. The drive bushing 60 may include an inner bore receiving the crank pin 78. The crank pin flat 80 may drivingly engage a flat surface in a portion of the inner bore of drive bushing 60 to provide a radially compliant driving arrangement. An Oldham coupling 96 may be engaged with the orbiting and non-orbiting scrolls 84, 86 to prevent relative rotation therebetween.

The non-orbiting scroll 86 may include an end plate 98 defining a discharge passage 100 and having a spiral wrap 102 extending from a first side thereof, an annular recess 104 defined in a second side thereof opposite the first side, and a series of radially outwardly extending flanged portions 106 (FIG. 1) engaged with the fasteners 52. The end plate 98 may additionally include a biasing passage (not shown) in fluid communication with the annular recess 104 and an intermediate compression pocket defined by the orbiting and non-orbiting scrolls 84, 86. The seal assembly 20 may form a floating seal assembly and may be sealingly engaged with non-orbiting scroll 86 to define an axial biasing chamber 110.

Figure 2:
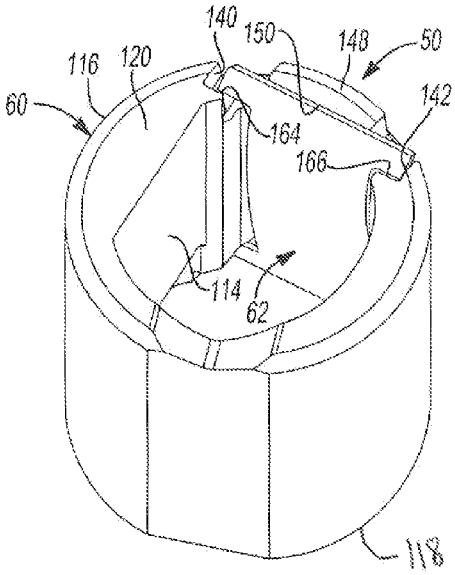
FIG. 2 is perspective view of the unloader bushing assembly from FIG. 1.
Figure 3:
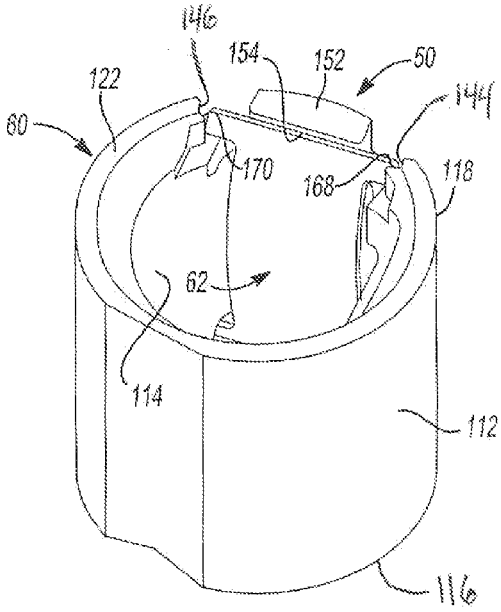
FIG. 3 is an additional perspective view of the unloader bushing assembly from FIG. 1.
Figure 4:
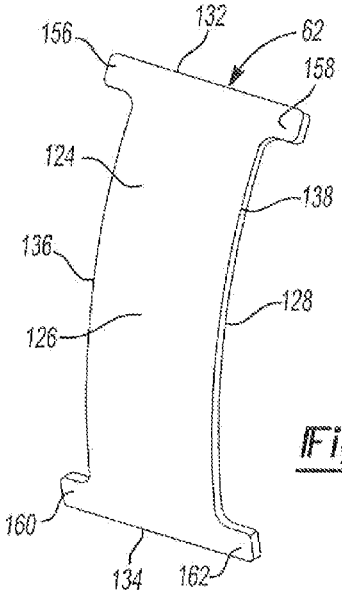
FIG. 4 is a perspective view of the spring from the unloader bushing assembly shown in FIGS. 2 and 3.

Referring to FIGS. 2-4, the drive bushing 60 may include an outer surface 112 engaged with the orbiting scroll 84 and a longitudinally extending opening 114 extending from a first longitudinal end 116 to a second longitudinal end 118. The first longitudinal end 116 may define a first end surface 120 and the second longitudinal end 118 may define a second end surface 122. The spring 62 may be located in the longitudinally extending opening 114 and may include a longitudinally extending body 124 disposed within the longitudinally extending opening 114 of the drive bushing 60.

The spring 62 may include inner and outer surfaces 126, 128, first and second longitudinal ends 132, 134 and first and second lateral ends 136, 138 extending between the first and second longitudinal ends 132, 134. At least a portion of the first longitudinal end 132 may extend laterally from the body 124 and overlap the first longitudinal end 116 of the drive bushing 60. At least a portion of the second longitudinal end 134 may extend laterally from the body 124 and overlap the second longitudinal end 118 of the drive bushing 60 to secure the spring 62 within the drive bushing 60.

The first longitudinal end 116 of the drive bushing 60 may define a first recess 140 including a first region of the first end surface 120 and a second recess 142 including a second region of the first end surface 120. The second longitudinal end 118 of the drive bushing 60 may define a third recess 144 including a first region of the second end surface 122 and a fourth recess 146 including a second region of the second end surface 122.

The first longitudinal end 116 of the drive bushing 60 may define a first guide region 148 at a location circumferentially between the first and second recesses 140, 142 that extends longitudinally outward from end surfaces defined by the first and second recesses 140, 142 and may define an inner surface 150 engaged with the first longitudinal end 132 of the spring 62. The second longitudinal end 118 of the drive bushing 60 may define a second guide region 152 at a location circumferentially between the third and fourth recesses 144, 146 that extends longitudinally outward from end surfaces defined by the third and fourth recesses 144, 146 and may define an inner surface 154 engaged with the second longitudinal end 134 of the spring 62.

In the example shown in FIGS. 2-4, the first longitudinal end 132 of the spring 62 may include a first tab 156 extending laterally from the first lateral end 136 and a second tab 158 extending laterally from the second lateral end 138. The second longitudinal end 134 of the spring 62 may include a third tab 160 extending laterally from the first lateral end 136 and a fourth tab 162 extending laterally from the second lateral end 138.

The first and second tabs 156, 158 may extend over the first end surface 120 at the first longitudinal end 116 of the bushing 60 and the third and fourth tabs 160, 162 may extend over the second end surface 122 at the second longitudinal end 118 of the bushing 60. More specifically, the first tab 156 may extend into the first recess 140, the second tab 158 may extend into the second recess 142, the third tab 160 may extend into the third recess 144 and the forth tab 162 may extend into the fourth recess 146 to secure the spring 62 longitudinally within the bushing 60.

The first longitudinal end 116 of the bushing 60 may include a first longitudinal wall 164 defining an inner end of the first recess 140 and a second longitudinal wall 166 defining an inner end of the second recess 142. Outer ends of the first and second recesses 140, 142 may be defined by the inner surface 150 of the first guide region 148. The first longitudinal end 132 of the spring 62 may be retained for lateral displacement between a first location defined by the first and second longitudinal walls 164, 166 and a second location defined by the inner surface 150 of the first guide region 148. The second longitudinal end 118 of the bushing 60 may include a third longitudinal wall 168 defining an inner end of the third recess 144 and a fourth longitudinal wall 170 defining an inner end of the fourth recess 146. Outer ends of the third and fourth recesses 144, 146 may be defined by the inner surface 154 of the second guide region 152. The second longitudinal end 134 of the spring 62 may be retained for lateral displacement between a third location defined by the third and fourth longitudinal walls 168, 170 and a fourth location defined by the inner surface 154 of the second guide region 152.

A number of variations on the arrangement shown in FIGS. 2-4 are illustrated in FIGS. 5-12. The alternate arrangements shown in FIGS. 5-12 may include similar features to the arrangement shown in FIGS. 2-4 and the common features will not be described again for simplicity. It is understood that the description of the common features applies equally to the arrangements shown in FIGS. 5-12, with the exceptions noted below.

Figure 5:
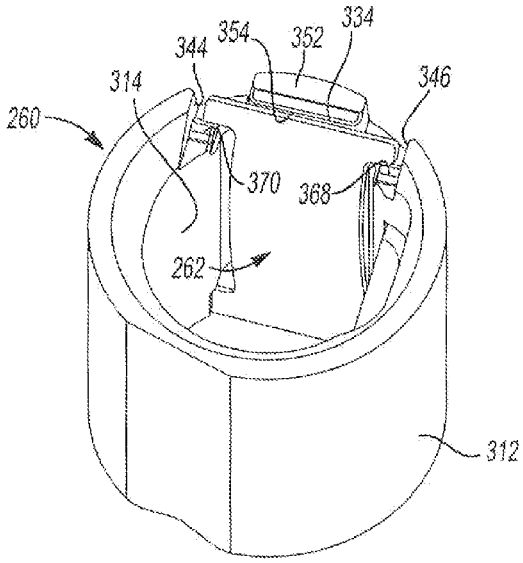
FIG. 5 is a perspective view of a first alternate unloader bushing assembly according to the present disclosure.

As seen in FIG. 5, the second end 318 of the drive bushing 260 may include the third and fourth recesses 344, 346 extending completely from the outer surface 312 to the longitudinally extending opening 314 of the drive bushing 260. The third and fourth longitudinal walls 168, 170 from FIGS. 2-4 may be replaced by protrusions 368, 370 extending from the base of each of the third and fourth recesses 344, 346. The second longitudinal end 334 of the spring 262 may be retained for lateral displacement between a location defined by the protrusions 368, 370 and a location defined by the inner surface 354 of the second guide region 352. A set of protrusions (not shown) similar to protrusions 368, 370 may alternatively or additionally be included on the first end 316 of the drive bushing 260.

Figure 6:
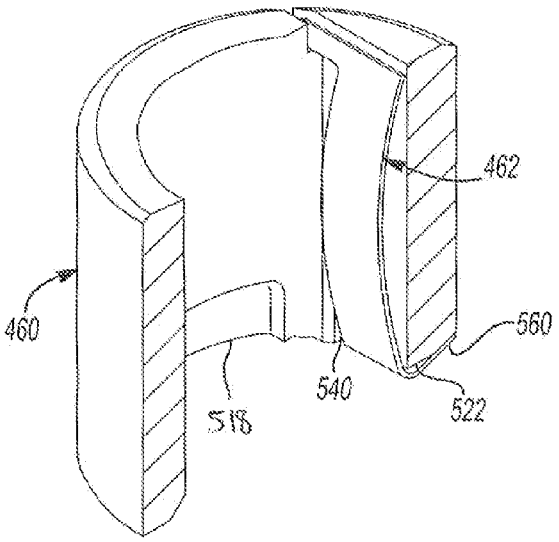
FIG. 6 is a section view of a second alternate unloader bushing assembly according to the present disclosure.
Figure 7:
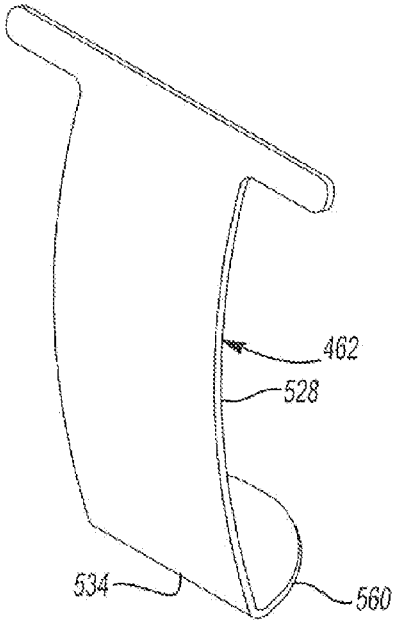
FIG. 7 is a perspective view of the spring from unloader bushing assembly of FIG. 6.

In the arrangement shown in FIGS. 6 and 7 the drive bushing 460 may include a modified second longitudinal end 518 and the spring 462 may include a corresponding modified second longitudinal end 534. The second longitudinal end 518 of the drive bushing 460 may include a central recess 540 defining the second end surface 522 in place of the third and fourth recesses 144, 146 and the second guide region 152 from FIGS. 2-4. The second longitudinal end 534 of the spring 462 may include a third tab 560 in place of the third and fourth tabs 160, 162 from FIGS. 2-4. The third tab 560 may form a hook-like structure and may extend outward from the outer surface 528 of the spring 462 into the central recess 540 and over the second end surface 522 defined by the bushing 460 to retain the spring 462 longitudinally within the bushing 460.

Figure 8:
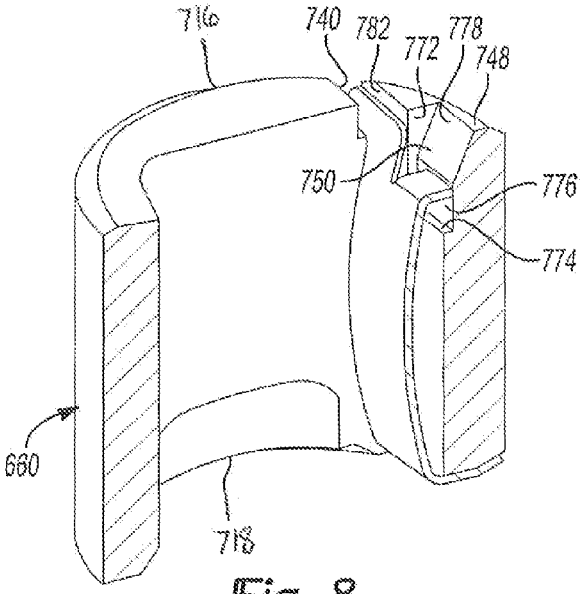
FIG. 8 is a section view of a third alternate unloader bushing assembly according to the present disclosure.
Figure 9:
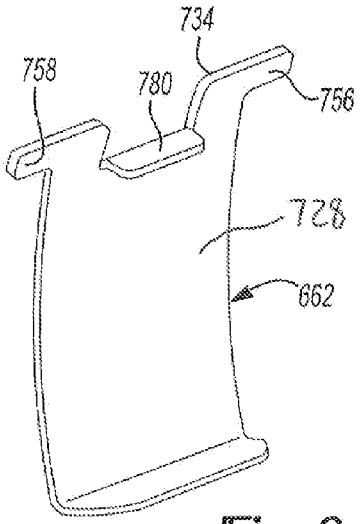
FIG. 9 is a perspective view of the spring from unloader bushing assembly of FIG. 8.

The drive bushing 660 and spring 662 of FIGS. 8 and 9 may be similar to the arrangement shown in FIGS. 6 and 7 with modifications to the first longitudinal end 716 of the drive bushing 660 and the first longitudinal end 734 of the spring 662. The first longitudinal end 716 of the drive bushing 660 may include an additional recess 772 forming the first guide region 748 and defining an additional end surface 774 at the first longitudinal end 716 of the drive bushing 660. The additional recess 772 may define the inner surface 750 of the first guide region 748. The inner surface 750 may include a first region 776 located longitudinally between the first and second longitudinal ends 716, 718 of the drive bushing 660 and a second region 778 extending from a longitudinal end of the first region 776 to the first longitudinal end 716 of the drive bushing 660. The first region 776 may extend generally parallel to a longitudinal axis of the drive bushing 660 and the second region 778 may extend at an angle radially outward from the first region 776.

The first longitudinal end 734 of the spring 662 may include an additional tab 780 located laterally between the first and second tabs 756, 758 and may extend outward from the outer surface 728 of the spring 662 into the additional recess 772 over the additional end surface 774. The additional tab 780 may initially be engaged with the first region 776 of the inner surface 750 to provide an initial stiffness or effective length for the spring 662. After the spring 662 is deflected a predetermined amount by the eccentric crank pin 78, the additional tab 780 may be displaced longitudinally past the first region 776 to the second region 778 where the additional tab 780 is no longer engaged with the inner surface 750. Instead, the first tab 756 may be engaged with an outer end 782 of the first recess 740 and the second tab 758 may be engaged with an outer end of the second recess (not shown) to provide a reduced spring stiffness or increased spring effective length.

Figure 10:
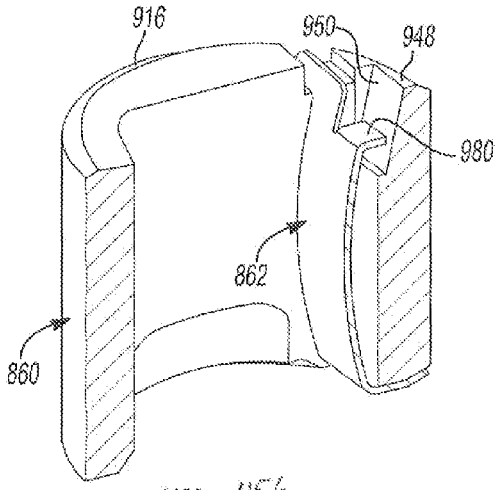
FIG. 10 is a section view of a fourth alternate unloader bushing assembly according to the present disclosure.

The arrangement shown in FIG. 10 may be similar to the arrangement shown in FIGS. 8 and 9 with the bushing 860 including a modified inner surface 950 of the first guide region 948 to provide a variable stiffness or a variable effective length for the spring 862. More specifically, the inner surface 950 may include a ramped surface extending at an angle radially outward toward the first longitudinal end 916 of the bushing 860. The additional tab 980 may continuously contact the inner surface 950 to vary the spring stiffness or effective length applied to the eccentric crank pin 78 as the spring 862 is deflected and the additional tab 980 travels along a longitudinal extent of the inner surface 950.

Figure 11:
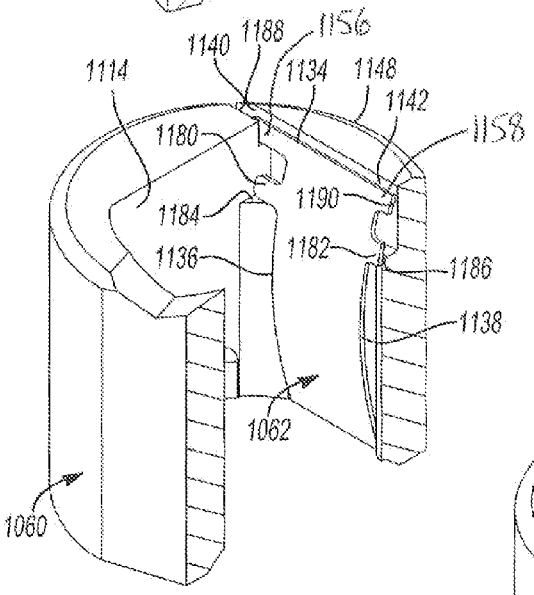
FIG. 11 is a section view of a fifth alternate unloader bushing assembly according to the present disclosure.
Figure 12:
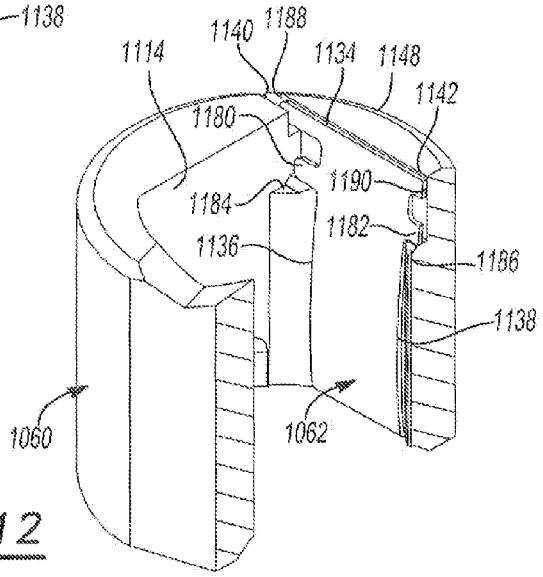
FIG. 12 is an additional section view of the unloader bushing assembly from FIG. 11.

The arrangement shown in FIGS. 11 and 12 includes an additional variable stiffness arrangement. The arrangement shown in FIGS. 11 and 12 may be similar to the arrangement of FIGS. 6 and 7, with the addition of third and fourth tabs 1180, 1182 at the first longitudinal end 1134 of the spring 1062. The longitudinally extending opening 1114 of the drive bushing 1060 may include additional inner surfaces 1184, 1186 laterally offset from one another. The first additional inner surface 1184 may be located on the first lateral end 1136 of the spring 1062 and engaged with the third tab 1180 and the second additional inner surface 1186 may be located on the second lateral end 1138 of the spring 1062 and engaged with the fourth tab 1182.

The additional inner surfaces 1184, 1186 may each extend from a region within the longitudinally extending opening 1114 of the drive bushing 1060 at an angle laterally outward to the first guide region 1148. The longitudinally extending opening 1114 may define a lateral offset from the additional inner surfaces 1184, 1186 to the first guide region 1148. The third tab 1180 may initially be engaged with the additional inner surface 1184 and the fourth tab 1182 may initially be engaged with the additional inner surface 1186. As the spring 1062 is deflected by the eccentric crank pin 78, the third and fourth tabs 1180, 1182 advance longitudinally along the additional inner surfaces 1184, 1186 and vary the spring stiffness based on the angular disposition of the additional inner surfaces 1184, 1186.

After the third and fourth tabs 1180, 1182 are displaced longitudinally beyond the additional inner surfaces 1184, 1186, the third and fourth tabs 1180, 1182 are no longer engaged with the drive bushing 1060. Instead, the first tab 1156 may be engaged with an outer end 1188 of the first recess 1140 and the second tab 1158 may be engaged with an outer end 1190 of the second recess 1142 to provide a reduced spring stiffness or increased effective spring length.

What is claimed is:

1. A compressor comprising:

a shell;

a bearing housing supported within said shell;

an orbiting scroll supported on said bearing housing;

a non-orbiting scroll meshingly engaged with said orbiting scroll;

an unloader bushing assembly including:

a drive bushing having an outer surface engaged with said orbiting scroll and defining a longitudinally extending opening extending from a first longitudinal bushing end to a second longitudinal bushing end, and a spring including a longitudinally extending body disposed within said longitudinally extending opening of said drive bushing and having first and second longitudinal spring ends, said first longitudinal spring end including a first tab extending laterally from said body and overlapping said first longitudinal bushing end, said second longitudinal spring end including a second tab extending laterally from said body and overlapping said second longitudinal bushing end to secure said spring within said drive bushing; and a drive shaft extending through said bearing housing and including an eccentric crank pin disposed within said longitudinally extending opening of said drive bushing and engaged with said spring.

2. The compressor of claim 1, wherein said first tab extends laterally from a first lateral spring end and said second tab extends laterally from a second lateral spring end opposite said first lateral spring end, said first and second tabs extending over a first end surface defined by said first longitudinal bushing end.

3. The compressor of claim 2, wherein said second longitudinal spring end includes a third tab extending laterally from said first lateral spring end and a fourth tab extending laterally from said second lateral spring end, said third and fourth tabs extending over a second end surface defined by said first longitudinal bushing end.

4. The compressor of claim 2, wherein spring includes an inner surface facing said eccentric crank pin and an outer surface opposite said inner surface, said second longitudinal spring end including third tab extending outward from said outer surface over a second end surface defined by said second longitudinal bushing end.

5. The compressor of claim 2, wherein said first longitudinal bushing end defines a first recess including a first region of said first end surface and a second recess including a second region of said first end surface with said first tab extending into said first recess and said second tab extending into said second recess.

6. The compressor of claim 5, wherein said drive bushing defines a guide region at a location circumferentially between said first and second recesses that extends longitudinally outward from end surfaces defined by said first and second recesses and defines an inner surface engaged with said first longitudinal spring end.

7. The compressor of claim 6, wherein said drive bushing includes a first longitudinal wall extending from said first recess and a second longitudinal wall extending from said second recess with said first longitudinal spring end retained for lateral displacement between a first location defined by said first and second longitudinal walls and a second location defined by said inner surface of said guide region.

8. The compressor of claim 5, wherein said spring includes an inner surface facing said eccentric crank pin and an outer surface opposite said inner surface, said first longitudinal spring end including an additional tab located laterally between said first and second tabs and extending outward from said outer surface over an additional end surface defined at said first longitudinal bushing end.

9. The compressor of claim 2, wherein said second longitudinal spring end includes a third tab extending laterally from said first lateral spring end and into a third recess defined by said second longitudinal bushing end and a fourth tab extending laterally from said second lateral spring end opposite said first lateral spring end and into a fourth recess defined by said second longitudinal bushing end.

10. The compressor of claim 1, wherein said drive bushing include a ramped inner surface at least partially defining said longitudinally extending opening, said first longitudinal spring end engaged with said ramped surface and applying a variable spring load against said eccentric crank pin as said first longitudinal spring end is displaced longitudinally along said ramped surface.

11. The compressor of claim 1, wherein said spring is generally convex along a longitudinal extent of said longitudinally extending body toward a center of said longitudinally extending opening.

12. The compressor of claim 1, wherein said spring includes an inner surface facing said eccentric crank pin and an outer surface opposite said inner surface, said first longitudinal spring end including a third tab extending outward from said outer surface over an end surface defined by said first longitudinal bushing end.

* * * * *